US011146889B2

(12) United States Patent
Wu et al.

(10) Patent No.: US 11,146,889 B2
(45) Date of Patent: Oct. 12, 2021

(54) DIAPHRAGM

(71) Applicant: AAC Technologies Pte. Ltd., Singapore (SG)

(72) Inventors: Meiwei Wu, Shenzhen (CN); Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 421 days.

(21) Appl. No.: 16/234,550

(22) Filed: Dec. 27, 2018

(65) Prior Publication Data

US 2019/0238985 A1 Aug. 1, 2019

(30) Foreign Application Priority Data

Jan. 27, 2018 (CN) ..... 201820140865.1

(51) Int. Cl.
*H04R 7/14* (2006.01)
*H04R 7/12* (2006.01)

(52) U.S. Cl.
CPC ..... *H04R 7/14* (2013.01); *H04R 7/127* (2013.01)

(58) Field of Classification Search
CPC .... H04R 7/14; H04R 7/127; H04R 2307/204; H04R 2307/207
See application file for complete search history.

(56) References Cited

U.S. PATENT DOCUMENTS 7,275,620 B1 * 10/2007 Diedrich ..... H04R 7/16 181/171
2017/0289698 A1 * 10/2017 Watanabe ..... H04R 3/04

* cited by examiner

*Primary Examiner* — Sunita Joshi
(74) *Attorney, Agent, or Firm* — IPro, PLLC; Na Xu

(57) ABSTRACT

The present disclosure provides a diaphragm. The diaphragm includes a dome portion located at a central position and an edge portion disposed around the dome portion. The edge portion is provided with a plurality of first wrinkles at corners of the edge portion. The first wrinkles extend from an inner side of the edge portion toward an outer side of the edge portion. The edge portion is further provided with at least one second wrinkle passing through all the first wrinkles that are at the same corner as the at least one second wrinkle. The second wrinkle extends along a corner extension direction of the corner at which the second wrinkle is located. The diaphragm of the present disclosure can effectively improve a twist, a swing, and distortion when the diaphragm vibrates, and improve acoustic performance.

3 Claims, 1 Drawing Sheet

DIAPHRAGM

CROSS-REFERENCE TO RELATED APPLICATIONS

This application claims the priority benefit of Chinese Patent Application Ser. No. 201820140865.1 filed on Jan. 27, 2018, the entire content of which is incorporated herein by reference.

TECHNICAL FIELD

The present disclosure relates to the field of speakers, and in particular, to diaphragms in the speakers.

BACKGROUND

A diaphragm serves as a core acoustic component of a speaker, and quality of design of the diaphragm directly affects acoustic performance of the speaker. The diaphragm generally includes a dome portion located at a central position and an edge portion disposed around the dome portion.

To improve a twist, a swing, and distortion when the diaphragm vibrates, and implement stable vibration of the diaphragm, wrinkle patterns are generally provided at corners of the edge portion, and the wrinkle patterns extend from an inner side of the edge portion toward an outer side of the edge portion.

However, as a requirement for better acoustic performance, a wrinkle pattern structure of an existing diaphragm already cannot satisfy a requirement for stable vibration of the diaphragm. A case of the twist, the swing, and the distortion still occurs when the diaphragm vibrates, and relatively good acoustic performance cannot be obtained.

Therefore, it is desired to provide a new diaphragm to resolve the foregoing problem.

DETAILED DESCRIPTION

The following further describes the present disclosure in detail by using specific implementations and with reference to the accompany drawings, to better understand the solution of the present disclosure and advantages of aspects of the present disclosure. In the following embodiment, an objective of providing the following specific implementations is to facilitate clearer and more thorough understanding of content of the present disclosure, rather than limit the present disclosure.

Figure 1:
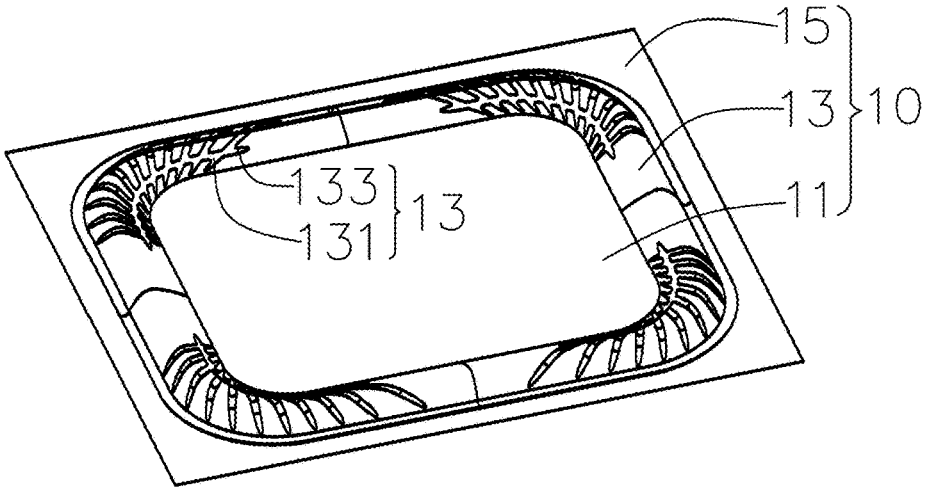
FIG. 1 is a schematic three-dimensional diagram of a diaphragm according to the present disclosure.
Figure 2:
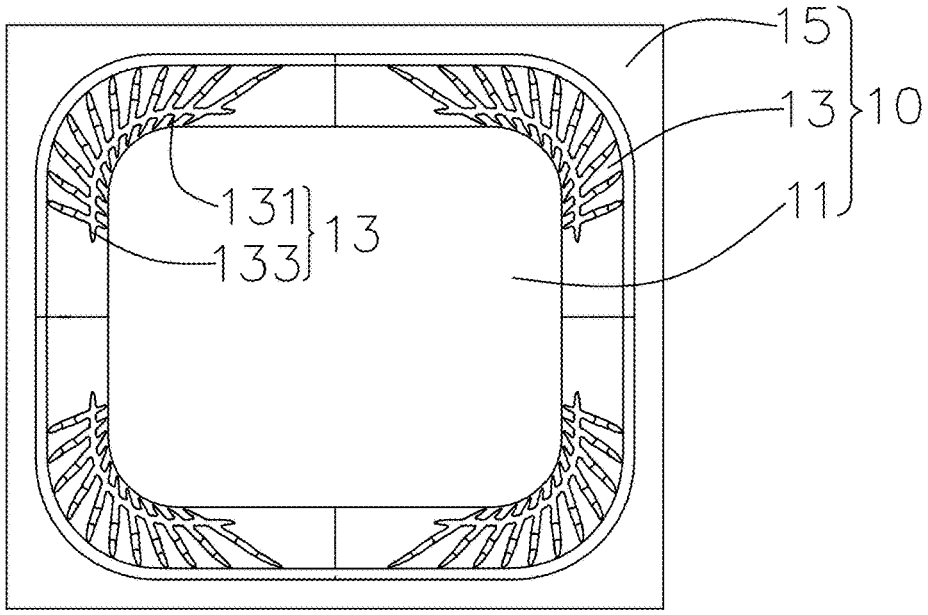
FIG. 2 is a schematic top view of a diaphragm according to the present disclosure.

FIG. 1 and FIG. 2 show a diaphragm 10 according to the present disclosure. The diaphragm 10 includes a dome portion 11 located at a central position, an edge portion 13 disposed around the dome portion 11, and a fixing portion 15 extending out of the edge portion 13.

The edge portion 13 is provided with a plurality of first wrinkles 131 at corners of the edge portion 13. The first wrinkles 131 extend from an inner side of the edge portion 13 toward an outer side of the edge portion 13. The edge portion 13 is further provided with at least one second wrinkle 133 passing through all the first wrinkles 131 that are at the same corner as the at least one second wrinkle 133. The second wrinkle 133 extends along a corner extension direction of the corner at which the second wrinkle 133 is located. The fixing portion 15 is configured to fixedly combine with a component such as a frame.

In this implementation, the edge portion 13 is an upward protrusion, and the first wrinkles 131 and the second wrinkles 133 are protrusions downward from the edge portion 13. In another implementation, alternatively, the edge portion 13 may be a downward protrusion, and the first wrinkles 131 and the second wrinkles 133 are protrusions upward from the edge portion 13. In other words, a protruding direction of the first wrinkle 131 is the same as that of the second wrinkle 133, and the protruding direction of the first wrinkle 131 is opposite to that of the edge portion 13.

Certainly, alternatively, the edge portion 13 may be an upward protrusion, and the first wrinkles 131 and the second wrinkles 133 are protrusions upward from the edge portion 13. Alternatively, the edge portion 13 is a downward protrusion, and the first wrinkles 131 and the second wrinkles 133 are protrusions downward from the edge portion 13. In other words, that the protruding direction of the first wrinkle 131 is the same as that of the second wrinkle 133, and the protruding direction of the first wrinkle 131 is the same as that of the edge portion 13.

Certainly, alternatively, the edge portion 13 may be an upward protrusion, the first wrinkles 131 are protrusions upward from the edge portion 13, and the second wrinkles 133 are protrusions downward from the edge portion 13. Alternatively, the edge portion 13 is a downward protrusion, the first wrinkles 131 are protrusions downward from the edge portion 13, and the second wrinkles 133 are protrusions upward from the edge portion 13. In other words, the protruding direction of the first wrinkle 131 is opposite to that of the second wrinkle 133, and the protruding direction of the first wrinkle 131 is the same as that of the edge portion 13.

Certainly, alternatively, the edge portion 13 may be an upward protrusion, the first wrinkles 131 are protrusions downward from the edge portion 13, and the second wrinkles 133 are protrusions upward from the edge portion 13. Alternatively, the edge portion 13 is a downward protrusion, the first wrinkles 131 are protrusions upward from the edge portion 13, and the second wrinkles 133 are protrusions downward from the edge portion 13. In other words, the protruding direction of the first wrinkle 131 is opposite to that of the second wrinkle 133, and the protruding direction of the second wrinkle 133 is the same as that of the edge portion 13.

It should be noted that the dome portion 11, the edge portion 13, and the fixing portion 15 may be separated structures, or may be integrated structures. In this implementation, the dome portion 11, the edge portion 13, and the fixing portion 15 are integrated structures and connected to each other. In this implementation, there is one second wrinkle 133, but there may alternatively be two or more second wrinkles 133. A quantity and positions of the second wrinkles 133 are not particularly limited.

Compared with the prior art, the diaphragm of the present disclosure can effectively improve a twist, a swing, and distortion when the diaphragm vibrates, and improve acoustic performance by providing the first wrinkles and the second wrinkles at the corners of the edge portion of the diaphragm.

The foregoing descriptions are merely implementations of the present disclosure. It should be noted herein that a person of ordinary skill in the art may further make improvements without departing from the creative concept of the present disclosure, but the improvements all fall within the protection scope of the present disclosure.

What is claimed is:

1. A diaphragm, comprising a dome portion located at a central position and an edge portion disposed around the dome portion, wherein the edge portion is provided with a plurality of first wrinkles at corners of the edge portion, the first wrinkles extend from an inner side of the edge portion toward an outer side of the edge portion, the edge portion is further provided with at least one second wrinkle passing through all the first wrinkles that are at the same corner as the at least one second wrinkle, and the second wrinkle extends along a corner extension direction of the corner at which the second wrinkle is located, a protruding direction of the first wrinkle is the same as that of the second wrinkle, and the protruding direction of the first wrinkle is the same as or opposite to that of the edge portion.

2. A diaphragm, comprising a dome portion located at a central position and an edge portion disposed around the dome portion, wherein the edge portion is provided with a plurality of first wrinkles at corners of the edge portion, the first wrinkles extend from an inner side of the edge portion toward an outer side of the edge portion, the edge portion is further provided with at least one second wrinkle passing through all the first wrinkles that are at the same corner as the at least one second wrinkle, and the second wrinkle extends along a corner extension direction of the corner at which the second wrinkle is located, a protruding direction of the first wrinkle is opposite to that of the second wrinkle, and the protruding direction of the first wrinkle is the same as that of the edge portion.

3. A diaphragm, comprising a dome portion located at a central position and an edge portion disposed around the dome portion, wherein the edge portion is provided with a plurality of first wrinkles at corners of the edge portion, the first wrinkles extend from an inner side of the edge portion toward an outer side of the edge portion, the edge portion is further provided with at least one second wrinkle passing through all the first wrinkles that are at the same corner as the at least one second wrinkle, and the second wrinkle extends along a corner extension direction of the corner at which the second wrinkle is located, a protruding direction of the first wrinkle is opposite to that of the second wrinkle, and the protruding direction of the second wrinkle is the same as that of the edge portion.

* * * * *